US006188182B1

(12) United States Patent
Nickols et al.

(10) Patent No.: US 6,188,182 B1
(45) Date of Patent: Feb. 13, 2001

(54) POWER CONTROL APPARATUS FOR LIGHTING SYSTEMS

(75) Inventors: Alan Hector Fergus Nickols, Surrey Hills; Robert Anthony Frederick Moss, Hampton Park, both of (AU)

(73) Assignee: NCON Corporation Pty Limited, Melbourne (AU)

( * ) Notice: Under 35 U.S.C. 154(b), the term of this patent shall be extended for 0 days.

(21) Appl. No.: 09/297,117

(22) PCT Filed: Oct. 24, 1996

(86) PCT No.: PCT/AU96/00670

§ 371 Date: Jun. 1, 1999

§ 102(e) Date: Jun. 1, 1999

(87) PCT Pub. No.: WO98/18296

PCT Pub. Date: Apr. 30, 1998

(51) Int. Cl.[7] ..... H05B 37/02

(52) U.S. Cl. ..... 315/294; 315/295; 315/159; 315/360

(58) Field of Search ..... 315/159, 294, 315/297, 360, 312, 316, 320, 322, 291, 295

(56) References Cited

U.S. PATENT DOCUMENTS

| | | | |
|---|---|---|---|
| 4,292,570 | 9/1981 | Engel . | |
| 4,398,131 | 8/1983 | Tarroux et al. . | |
| 4,733,138 | 3/1988 | Pearlman et al. . | |
| 4,804,916 | 2/1989 | Frank . | |
| 5,357,170 | 10/1994 | Luchaco et al. . | |
| 5,523,656 | 6/1996 | Luursema . | |
| 6,046,549 * | 4/2000 | James | 315/291 |

FOREIGN PATENT DOCUMENTS 6393019 4/1998 (JP) .

* cited by examiner

*Primary Examiner*—David Vu
(74) *Attorney, Agent, or Firm*—Baker Botts L.L.P.

(57) ABSTRACT

A power control apparatus, particularly for lighting systems such as fluorescent lights. A power variation circuit (16) is provided coup led between a mains electrical input power source and at least one power output to a load (6) such as a lighting system. The power variation device is controllable to vary the power level supplied to the load according to control signals from a digital processing circuit(10). Monitoring circuitry (12, 14) is coupled to the digital processing circuit (10) to provide monitoring signals relating to electrical parameters of the input power source (4) and/or the at least one power output (9). The digital processing circuit (10) is responsive to a condition of the monitoring signals to control the power variation circuit (16) to supply the power output (9) at a first predetermined level for a predetermined time period and thereafter to reduce power output to a second predetermined level. The second predetermined level and the predetermined time period are set by the digital processing means according to control parameters stored in a first memory. The stored control parameters may include indications of predetermined times of day and/or days of week and corresponding values for the second predetermined level, wherein the digital processing circuit (10) is responsive to a timer at the predetermined times of day and/or days of week to change the second predetermined level to the corresponding value stored in the memory.

14 Claims, 6 Drawing Sheets

POWER CONTROL APPARATUS FOR LIGHTING SYSTEMS

FIELD OF THE INVENTION

This invention relates to a power control apparatus which is particularly useful for lighting systems, such as those employing fluorescent lights.

BACKGROUND OF THE INVENTION

Studies have shown that many buildings, for example, tend to be over illuminated by present lighting systems for the purposes required of them. Over illumination in this way results in a wastage of electrical power. Most often fluorescent lights are used in lighting systems for large buildings, for example, in view of their increased efficiency as compared to many other lights. Also, the relationship between light output and power required in a fluorescent light is non-linear, and it has been found that a significant decrease in power usage by fluorescent lights can be achieved without a correspondingly noticeable change in light output in many instances. However, if reduced power is continuously supplied to a fluorescent lighting system, the lights may experience starting difficulties, such as increased flickering time, which can reduce the life span of the lights. Furthermore, it may be desired to adjust the light level output of the lights, and in a large lighting system installation it may be desired to alter the light output or the power consumed thereby from a remote or centralised location.

SUMMARY OF THE INVENTION

In accordance with the present invention there is provided a power control apparatus for lighting systems comprising:

- a power variation means coupled to receive an input power source of AC electricity and produce a controllable output power source of AC electricity for operating an electrical load comprising at least one light;
- monitoring means for monitoring electrical parameters of the input power source and/or the output power source to produce monitoring signals;
- a digital processing means coupled to receive said monitoring signals and coupled to said power variation means so as to control said power variation means to vary said output power source between a maximum output level and a minimum output level;
- a timer coupled to said digital processing means; and
- a first memory storing control parameters and coupled to said digital processing means;
- wherein said digital processing means is responsive to a condition of said monitoring signals to control said power variation means to produce said output power source at a first predetermined level for a predetermined time period and thereafter to reduce said output power source to a second predetermined level, and wherein said second predetermined level and said predetermined time period are set by said digital processing means according to the control parameters stored in said first memory.

Preferably said stored control parameters include indications of predetermined times of day and/or days of week and corresponding values for said second predetermined level, and wherein said digital processing means is responsive to said timer at said predetermined times of day and/or days of week to change said second predetermined level to the corresponding value stored in said memory.

In a preferred form of the invention, at least one light sensor is coupled to the digital processing means, and the digital processing means is also responsive to a light level detected by the at least one light sensor to increase or decrease the second predetermined level. In one form of the invention, the apparatus includes a plurality of light sensors coupled to said digital processing means, each producing a respective detected light level value, and wherein said digital processing means is operative to calculate a weighted average of the detected light level values on the basis of preselected respective weighting factors stored in said memory, said digital processing means being responsive to the weighted average to increase or decrease said second predetermined level.

Preferably, the apparatus further comprises an input port coupled to the digital processing means for receiving control commands, wherein said digital processing means is responsive to a first control command to change said stored control parameters including said second predetermined level.

Preferably, a second memory is also provided coupled to the digital processing means for storing performance data, and wherein for each power variation in said output power source said digital processing means stores performance data in said second memory. The performance data may include data representing the output level of said output power source and the time the power variation occurred.

In one form of the invention a plurality of power variation means are provided coupled to a single digital processing means, with each power variation device being arranged to supply its output power source to a corresponding different electrical load. In this configuration, the digital processing means is preferably adapted to control each of the power variation means separately according to different corresponding second predetermined levels.

Various forms of power variation means may be utilised in the invention. For example, the power variation means may comprise a variable transformer, wherein said first predetermined level corresponds to a larger AC voltage than said first predetermined level. Alternatively, the power variation means may comprise, for example, a waveform modification device, such as a silicon controlled rectifier (SCR), wherein the difference between the first and second predetermined levels is effected by varying the firing time of the SCR with respect to the voltage zero crossing point of the AC electricity input power source.

In a preferred form of the invention, said power variation means comprises a variable transformer, and wherein said first predetermined level corresponds to a larger AC voltage than said second predetermined level. Preferably, said monitoring means monitors line voltage and/or line current of said input power source in order to determine the zero crossing times thereof, and wherein said digital processing means is adapted to control said power variation means to vary the output power source only at least substantially at a said zero crossing time.

As can be determined by those skilled in the art from the present specification, embodiments of the invention provide for a power control apparatus which can be utilised to reduce power consumption of an electrical load such as a fluorescent lighting system. When a condition such as the turning on of fluorescent lights is detected by the monitoring means, the preferred power control apparatus responds by increasing the output power source to a first predetermined level (eg maximum available power) in order to facilitate starting of the lights. After a predetermined time period the output power source is then reduced to a second predetermined level in order to conserve electrical power. The second predetermined level and thus the amount of power saving, is adjustable by way of an input port for receiving power control commands. The second predetermined level may also be adjusted by the influence of other inputs, such as at selected times of the day, or in response to a light sensor which measures ambient light.

BRIEF DESCRIPTION OF THE DRAWINGS

The invention is described in greater detail hereinafter by reference to several embodiments thereof illustrated by way of example in the accompanying drawings, wherein.

DETAILED DESCRIPTION OF THE INVENTIONS

Figure 1:
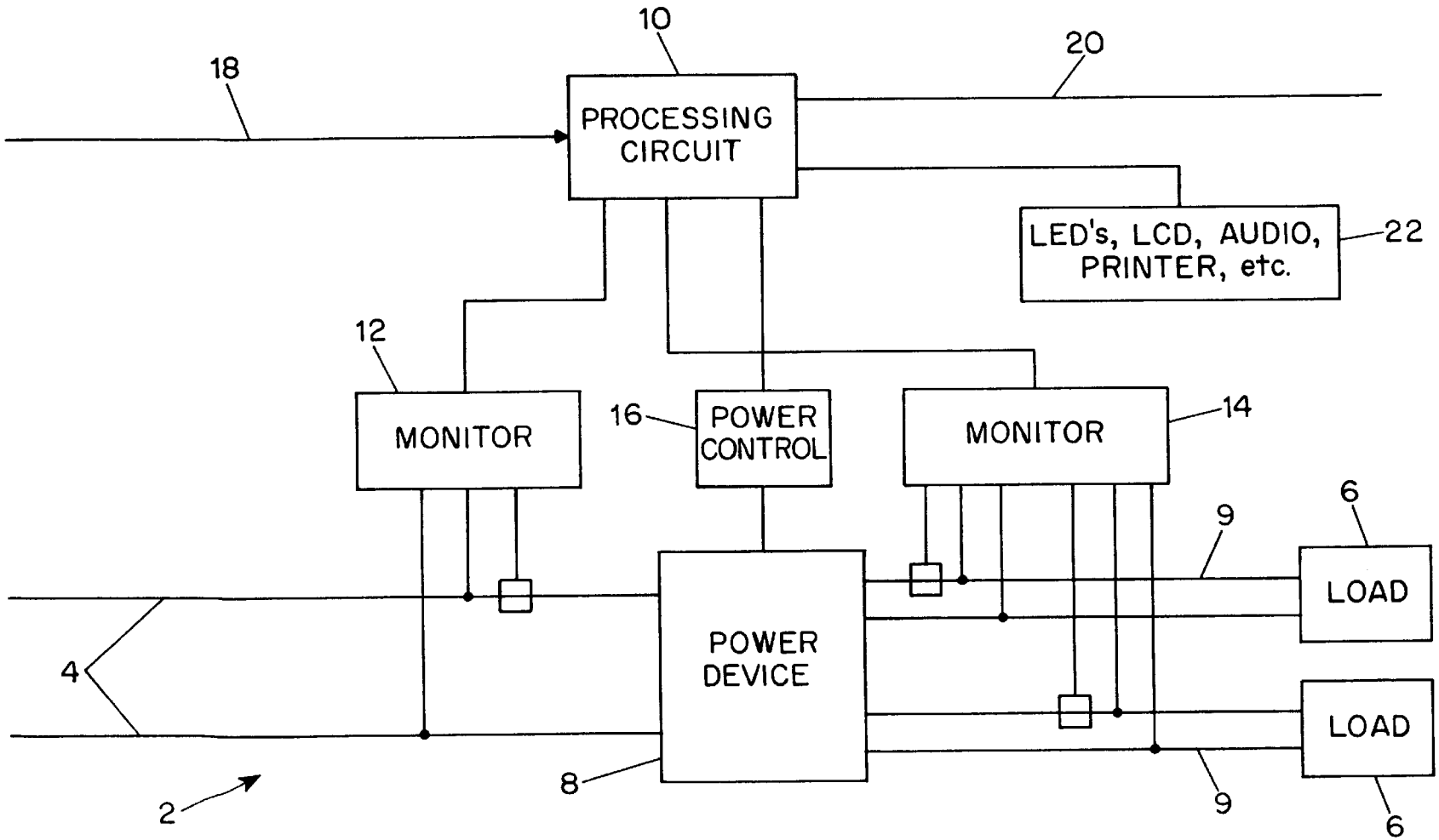
FIG. 1 is a block diagram of a power control apparatus according to a first embodiment.

A power control apparatus 2 is illustrated in FIG. 1 in block diagram form, coupled between a mains AC electrical input power source 4 and one or more electrical loads 6, such as a fluorescent or discharge lighting system, or the like. The power control apparatus 2 comprises generally a power variation means in the form of power device 8, and a digital processing means embodied in microprocessor circuit 10. The power device 8 is coupled to receive the mains electrical input power source 4, and provides at least one output power source 9 providing power to the at least one load 6. Monitoring circuitry 12, 14 is provided for monitoring electrical parameters of the mains electrical input power source 4 and output power sources 9, respectively. As shown diagrammatically in FIG. 1, each of the monitoring circuits 12, 14 receive signals which are indicative of voltage and current flow of the input and output power sources, respectively, and provide input to the digital processing circuit 10. Thus, as will be apparent to those skilled in the art, each of the monitoring circuits 12, 14 advantageously includes appropriate signal filtering and conditioning circuitry, and conversion circuitry for providing inputs to the digital processing circuit 10 in appropriate signal levels and formats, indicative of the voltages and currents monitored. Analog-to-digital conversion circuitry is also included in the monitoring circuits 12, 14 in order to provide the appropriate inputs to the digital processing circuit 10.

The power device 8 primarily provides a means for varying the power supplied to the electrical loads 6 through each of the output power sources 9. Several methods of varying the power supplied to the output power sources 9 are applicable, and the particular form of the power device 8 will depend upon the power variation method employed. For example, one way of reducing the power utilised by a load 6 is to supply the load at a reduced voltage. In that case, the power device 8 may comprise a voltage reduction transformer, and it is preferred that the transformer output voltage be capable of variation between at least 100% of input voltage down to a fraction of the input voltage such as 50%. This can be achieved through the use of, for example, an auto-transformer of conventional form, which has a plurality of voltage taps or is continuously variable. In order to vary the output voltage of the auto-transformer, the output tap is moved from one connection to another which, depending upon the physical characteristics of the transformer, can be achieved mechanically or through electrical switching. It will be readily apparent to those skilled in the art that the switching or mechanical movements, such as by way of stepper motor, required in order to vary the output voltage can be achieved by conventional means, and thus the details of implementation are not included here so as to avoid clouding the clarity of description of the invention.

Another way in which the power output of the power device can be varied from the input power source level is through the use of waveform modification such as may be achieved utilising a silicon controlled rectifier (SCR) or thyristor circuit. In that case, the level of output power from the power device can be varied by varying the firing time of the SCR or thyristor. By increasing the firing time with respect to the zero crossing point of the source power input voltage waveform, it is possible to vary the power delivered to the load 6 at the output of the power device 8. The manner in which the firing time of a waveform modification circuit of the type described will also be readily apparent to those skilled in the art, and thus is not described in detail.

The power device 8 is coupled to the digital processing circuit 10 by way of a power control circuit 16. The function of the power control circuit 16 is primarily to receive control signals from the digital processing circuit 10 and translate those signals into the form required for controlling the power variation of the power device 8. For example, where the power device 8 comprises a continuously variable auto-transformer whose output is controlled mechanically through the use of a stepper motor or the like, the power control circuit 16 is adapted to translate logic level control signals output from the digital processing circuit 10 into electrical signals for operating the stepper motor so as to vary output of the power device 8. On the other hand, for different embodiments of the power device 8, the power control circuitry 16 may not be required, or may be incorporated in the digital processing circuit circuit 10. For example, if the power device 8 comprises waveform modification circuitry such as SCRs which require only logic level signals which are timed accurately, then those firing signals may be provided directly from the digital processing circuit 10.

The digital processing circuit 10 may comprise any suitable digital processing circuitry, such as a microprocessor or microcontroller circuit or the like having provision for input and output of signals, and memory for storing control algorithms and data. For example, an 8251 microcontroller circuit, which will be recognised by those of skill in the art, can be effectively utilised in the digital processing circuit 10. As mentioned, the digital processing circuit 10 receives input signals from the monitoring circuits 12 and 14, and outputs control signals to the power device 8 by way of the power control circuitry 16. The digital processing circuit 10 is also provided with a programming input port 18, an output data port 20, and optionally is coupled to one or more display devices 22.

Figure 4:
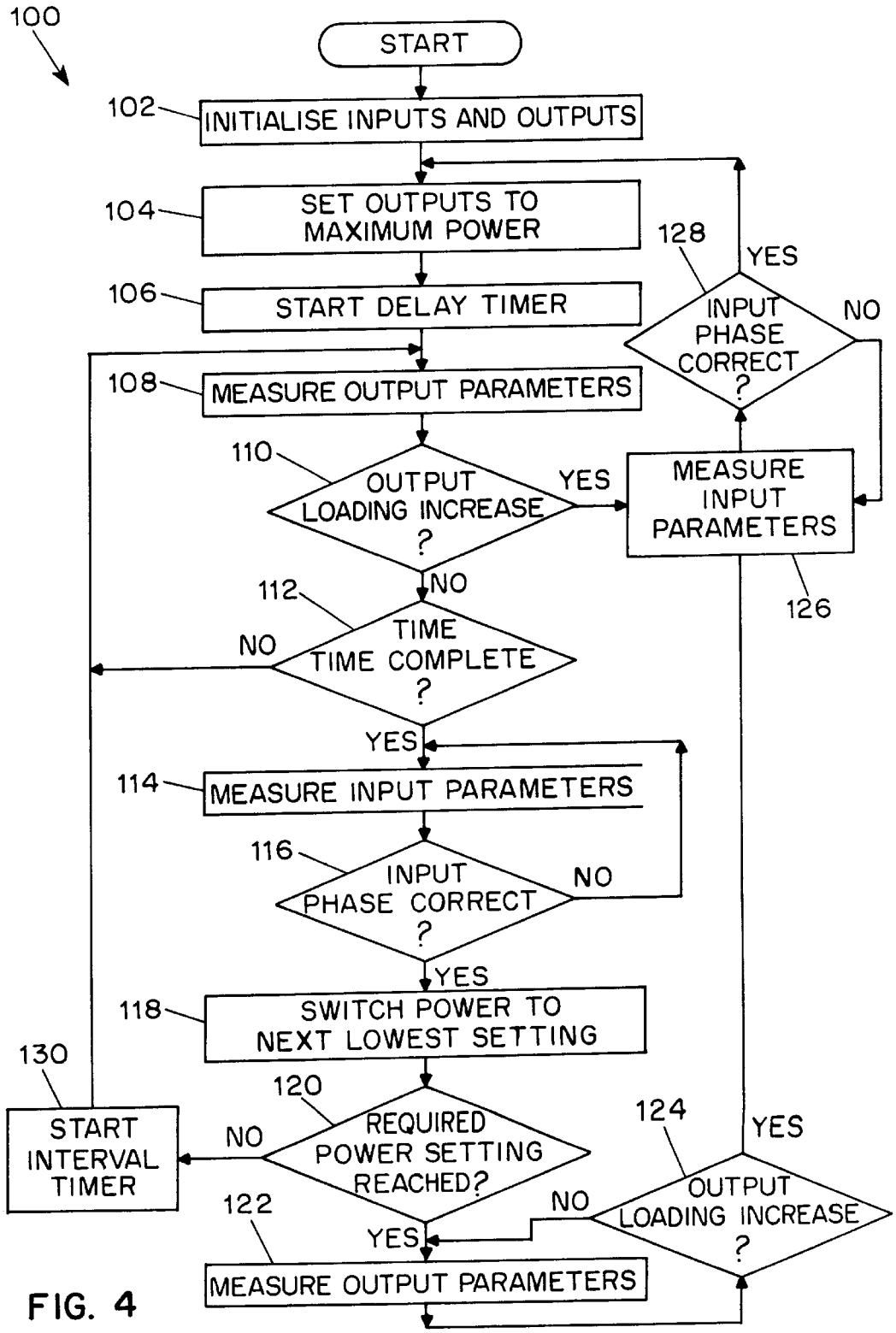
FIG. 4 is a functional flow diagram illustrating an algorithm for controlling a microprocessor device in an embodiment of the invention.

The digital processing circuit 10 includes processing circuitry which functions under the control of instructions stored in a memory circuit, preferably a non-volatile form of memory, such as ROM, PROM, EPROM, flash RAM or battery backed RAM. The circuit 10 is also provided with memory such as RAM memory for storing control parameters (which may be received from the programming port 18) and storing data to be output by way of the output port 20 or display device 22. The primary function of the digital processing circuit 10 is to act in accordance with its programmed instructions and control parameters, and on the basis of inputs received from the monitoring circuits 12, 14 and programming input port 18, so as to control the power device 8, and in particular the output power directed to the loads 6 through output power sources 9. FIG. 4 illustrates an example of a control algorithm for the microprocessor control circuit 10. The algorithm illustrated in the flow chart diagram of FIG. 4 in practice would be embodied in instruction codes stored in memory and executed by the microprocessor or microcontroller, although in an alternative the digital processing circuitry 10 could comprise a programmable logic circuit (PLC) or the like, in which case the algorithm may be hard wired into the PLC. As mentioned, in addition to memory storage for the control instructions, the digital processing circuit 10 preferably also is provided with memory storage for control parameters which may be received, for example, by way of the programming port 18. The control parameter data stored in the digital processing circuit 10 would typically include:

- data indicative of a reduced operating power level for the loads coupled to the control apparatus;
- the number of steps between the reduced operating power level and the full operating power level where the power device 8 is variable in discrete steps;
- the time delay, when new load is added, to remain at full output power level before decrementing to the reduced output power level;
- a threshold value indicating the amount of new load that must be added for the output power source to be switched to full output power; and
- the time interval to remain at each step where the power level varies in discrete steps or, where the power level is continuously variable, the total time to reduce the power level from the full output level to the reduced output level.

Figure 6:
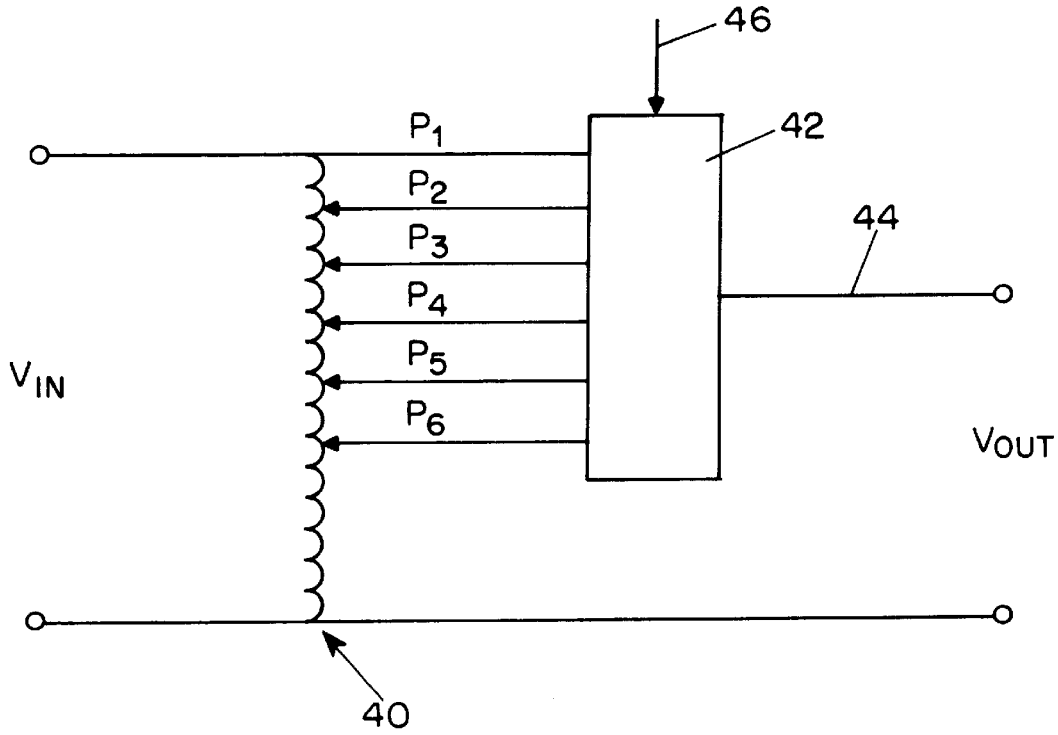
FIG. 6 illustrates an example of a power device for use in embodiments of the invention.

Referring to FIG. 6, there is illustrated a simplified diagram of an auto-transformer 40 which may be utilised in the power device 8 of embodiments of the present invention. The auto-transformer 40 is configured to receive mains input voltage $V_{IN}$ at the primary terminals thereof, and has a plurality of taps labelled $P_1$ to $P_6$ for secondary terminals. The taps $P_1$ to $P_6$ are coupled to respective inputs of a multiplexing circuit 42 which has a single output 44 which provides an output voltage $V_{OUT}$. The multiplexing circuit 42 is constructed so as to couple one and only one of the inputs thereof to the output 44, in accordance with a command input 46, provided in practice from the digital processing circuit 10.

By way of example, the taps $P_1$ to $P_6$ may be arranged so as to enable variation of the output voltage $_{OUT}$ within the range of 100% $V_{IN}$ to 50% $V_{IN}$ in 10% increments. Accordingly, the output voltage and consequently the output power supplied to the load, can be varied by changing the transformer tap to which voltage output line 44 is coupled. As mentioned, this is achieved through the use of multiplexing circuit 42 on command from the digital processing circuit 10. The switching from one tap to another is carried out at the zero crossing point time of the input voltage waveform so as to avoid significant discontinuities in the output voltage waveform thereby avoiding the introduction of noise into the output of the power device. It is also preferred that the output power be reduced by only a single increment at a time, with a delay in between so as to effect a gradual decrease in output power. On the other hand, when it is necessary to increase the output power, such as to enable starting of additional fluorescent lights which have been added to the load, then the output power is preferred to be increased to its maximum as soon as possible rather than incrementally.

Figure 7:
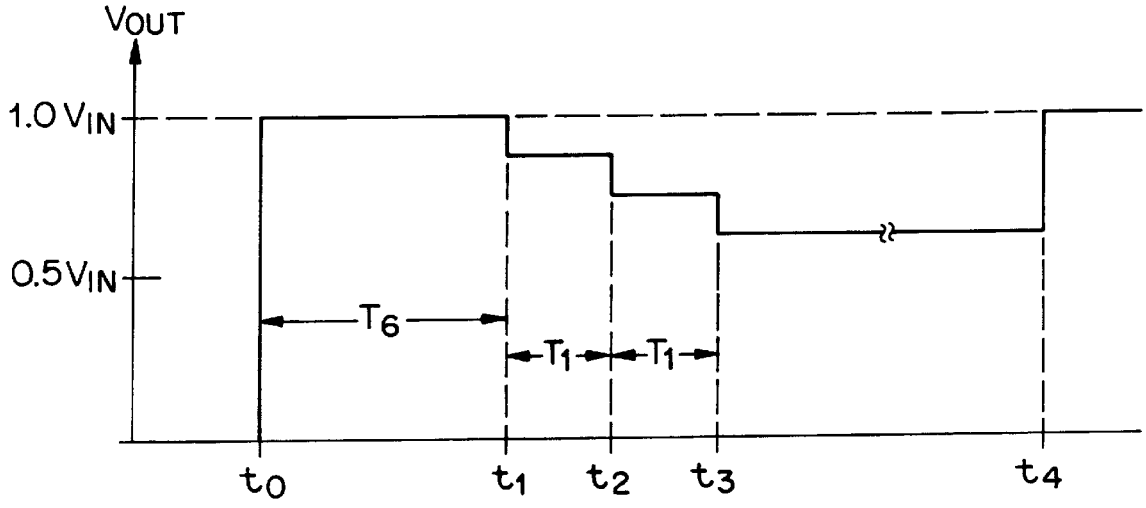
FIG. 7 is a timing diagram.

FIG. 7 illustrates a graph of output voltage referenced to input voltage for a power control apparatus employing a power device of the type shown in FIG. 6 during operation. When first initiated ($t_0$) the microprocessor controller of the power control apparatus sets the output voltage of the power device to maximum voltage (maximum power level). The output voltage remains at maximum for a predetermined time period $T_S$, after which at time $t_1$ the voltage is reduced by one increment. This reduction by a single increment corresponds, for example, to the multiplexing circuit 42 switching the connection of output line 44 from tap $P_1$ to tap $P_2$. The output voltage remains at that voltage for an interval $T_I$ before being decremented once more at time $t_2$. Again the voltage remains constant for the interval T, before being decremented again (at time $t_3$). By this time the output voltage has reached, in this example, 70% of the input voltage $V_{IN}$, corresponding to transformer tap $P_4$. In the present example, that output voltage corresponds to the desired output power level for the power control apparatus, and thus the output voltage remains at that level without being further decremented. When additional load is added, such as by switching on additional fluorescent lights, the output voltage is increased again to the maximum (illustrated at time $t_4$) and thereafter the output voltage returns to its quiescent level incrementally as before described, unless additional load is added in the meantime.

Referring to the above example, the parameter data which might typically be stored in memory by the digital processing circuit 10 would be the reduced (quiescent) output power level, or data corresponding thereto such as the identification of the transformer tap or the number of decrements from maximum voltage level or the actual output voltage as measured by the output monitoring circuitry, the time period to remain at maximum voltage ($T_S$), the decrement time interval $T_I$, and the threshold increase in load required before returning to maximum voltage.

For example, consider a power control apparatus in which the power device is constructed for an input voltage of 240 V a.c., and an output voltage of 240 V to 150 V variable in steps of 10 V (e.g. an auto-transformer having ten secondary taps). Control parameters for such an arrangement might be, for a typical application:

| | |
|---|---|
| Reduced output | $V_R$ = 200 V |
| Maximum voltage time | $T_S$ = 20 seconds |
| Decrement interval time | $T_1$ = 3 seconds |
| Load increase threshold | $I_T$ = 0.5 Amp output |

Referring now to FIG. 4, a flow chart 100 of a control algorithm for a microprocessor of the digital processing circuit 10 is shown, beginning with an initialisation step 102, where the microprocessor and its various inputs and outputs are initialised in order to ensure that the relevant signals are able to be received and dispatched. At this time, also, the microprocessor consults its associated memory to retrieve the control parameters of the type discussed above. Initially the output power to each of the loads 6 is set to maximum power (step 104), for example to facilitate starting of fluorescent lights. This is achieved by the digital processing circuit 10 controlling the power device 8, by way of the power control circuit 16 where applicable, in order to set the power device to provide maximum output power (e.g. full mains line voltage). In the example of FIG. 6, this would correspond to a control signal on line 46 from the digital processing circuit controlling the multiplexing circuit 42 so as to couple output line 44 to the auto-transformer tap Pl. Once the power device is set to maximum power, a delay timer is started at step 106, in order to begin timing the maximum power interval ($T_S$, referring to FIG. 7).

Parameters of the power device output are measured (step 108) by way of the monitoring circuitry 14 coupled to the output power source 9. Typically these parameters would include the output line voltage and output line current supplied to each load. If the line current supplied to a particular load increases, this may be indicative of an increased load, e.g. by extra lights being switched on. If the load remains constant, the procedure passes from step 110 to step 112 where it is determined whether or not the time delay $T_S$ has expired. Whilst the time delay $T_S$ remains unexpired, the procedure continues to monitor the output parameters for loading increase by repeating steps 108, 110 and 112. A loading increase is detected by comparing values of the measured output line current over time to sense an increase in current. When an increased current is detected, the amount of increase is compared to the load increase threshold control parameter in order to determine whether the increased current constitutes an increase in load worthy of returning the output to full power level.

If an increase in load is detected at step 110, the procedure passes to step 126 at which time the input parameters monitored by the monitoring circuitry 12 are measured. The monitoring circuit 12 may monitor the mains input power source line voltage and current in a different way to the monitoring circuit 14 because it is phase information of the input electrical signals which are particularly important in this instance. As mentioned previously, it is preferred that any switching or variation between power levels by the power device take place at the zero crossing time of the input power source waveform so as to avoid noise and transitory phenomenon during switching. Thus, instantaneous values of the voltage and current waveforms may be supplied by the monitoring circuitry 12, as compared to peak or RMS values supplied by the circuitry 14. One way in which to detect the zero crossing point is by way of digital signal processing (DSP) circuitry included in the digital processing circuit 10. For example, digital samples of the instantaneous mains input power source voltage and current levels can be analysed by DSP for detection of the zero crossing points thereof. It will be readily recognised that the implementation of that feature is within the knowledge of those skilled in the art.

The input parameters are monitored at steps 126 and 128 until the phasing of the signals is appropriate (eg at the zero crossing point) before the procedure passes to step 104, whereupon the power of the power device 8 is set to maximum level, as described herein above.

When the maximum power time delay $T_S$ is complete (step 112), the procedure sets about decrementally decreasing the power level to the required (reduced) power setting. This begins at steps 114 and 116 where the input parameters are monitored in similar fashion to steps 126 and 128, until the input phasing is correct. When the phasing reaches the zero crossing point, the power device 8 is controlled by the digital processing circuit 10 so as to decrement the output power level (step 118). Referring again to FIG. 6, in the first instance this action may be reducing the output voltage from 1.0 $V_{in}$ to 0.9 $V_{in}$ by changing the multiplexor 42 connection from auto-transformer tap $P_1$ to $P_2$. The digital processing circuit 10 then determines whether the pre-selected reduced power level has been reached, by comparison with the stored control parameter data mentioned previously. In the example of FIG. 7, this occurs after the power supplied to the load 6 has been decremented by the power device three times. If the desired reduced power level has not yet been reached, then the procedure returns to step 108, after initiating an interval timer which corresponds to the time interval $T_I$ (FIG. 7). Typically the interval timer might be of the order of several seconds, whereas the maximum power delay timer ($T_S$) may be of the order of 15 seconds or so.

In the example mentioned above concerning the control parameters, the reduced output power level was presented in terms of the actual output voltage $V_R$ supplied to the load. In that case, the step 120 would be accomplished by comparing the control parameter $V_R$ with the measured output voltage supplied by the monitoring circuit 14. Then, if $V_R$ is greater than the actual output voltage the reduced output power level has been reached, and if not then the procedure continues to decrement the output level again.

Once the desired reduced power level has been reached, the microprocessor control algorithm enters a monitoring loop comprising steps 122 and 124, which monitor the output parameters from monitoring circuitry 14, and detect any load increase, similar to steps 108 and 110. If an increase in load current greater than the threshold is detected, the controller algorithm is passed to step 126 to monitor the phasing of the input signals before returning the output power to maximum level at step 104.

Figure 2:
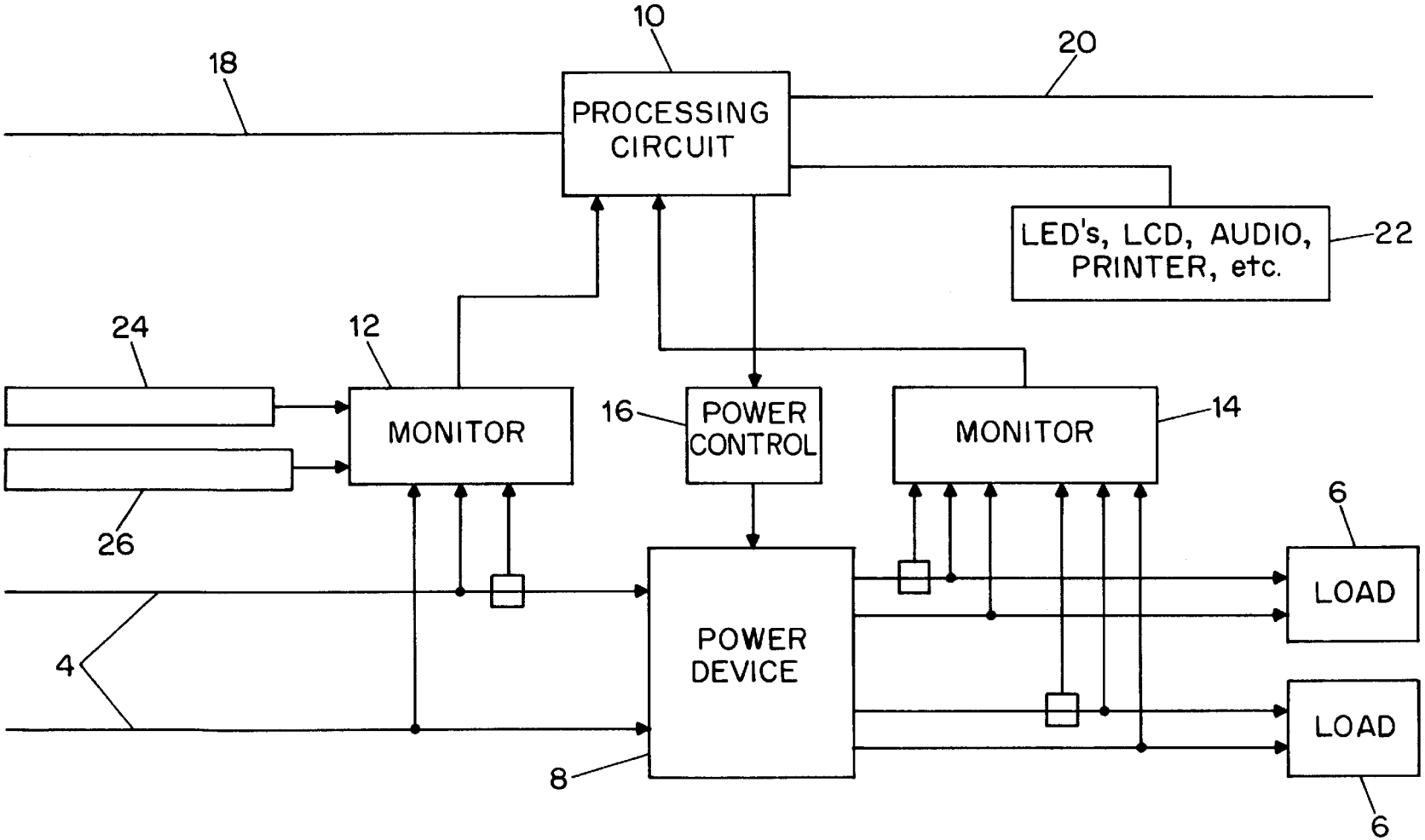
FIG. 2 is a block diagram of a power control apparatus according to a second embodiment.

FIG. 2 illustrates a power control apparatus according to an embodiment of the present invention which includes additional features to the embodiment shown in FIG. 1. In particular, the input monitoring circuitry 12 includes an input from a light level measurement device 26, such as a photo-diode or the like. The light level measurement device would typically be positioned within a space illuminated by the fluorescent lights which constitute one of the loads 6, so as to provide a measurement of the light produced from the load supplied by the power control apparatus. This enables the digital processing circuit 10 to implement a feedback loop, so that the power device can be controlled so as to output power according to a specified light level, rather than a particular power level as described hereinabove. The light level to be supplied may be set by way of a light level setting input 24, or may be specified by the control parameter data stored in memory. The control steps required in the procedure for the digital processing circuit 10 which are necessary to implement the light level feedback control will be apparent to those skilled in the art, and need not be described in detail here.

Figure 3:
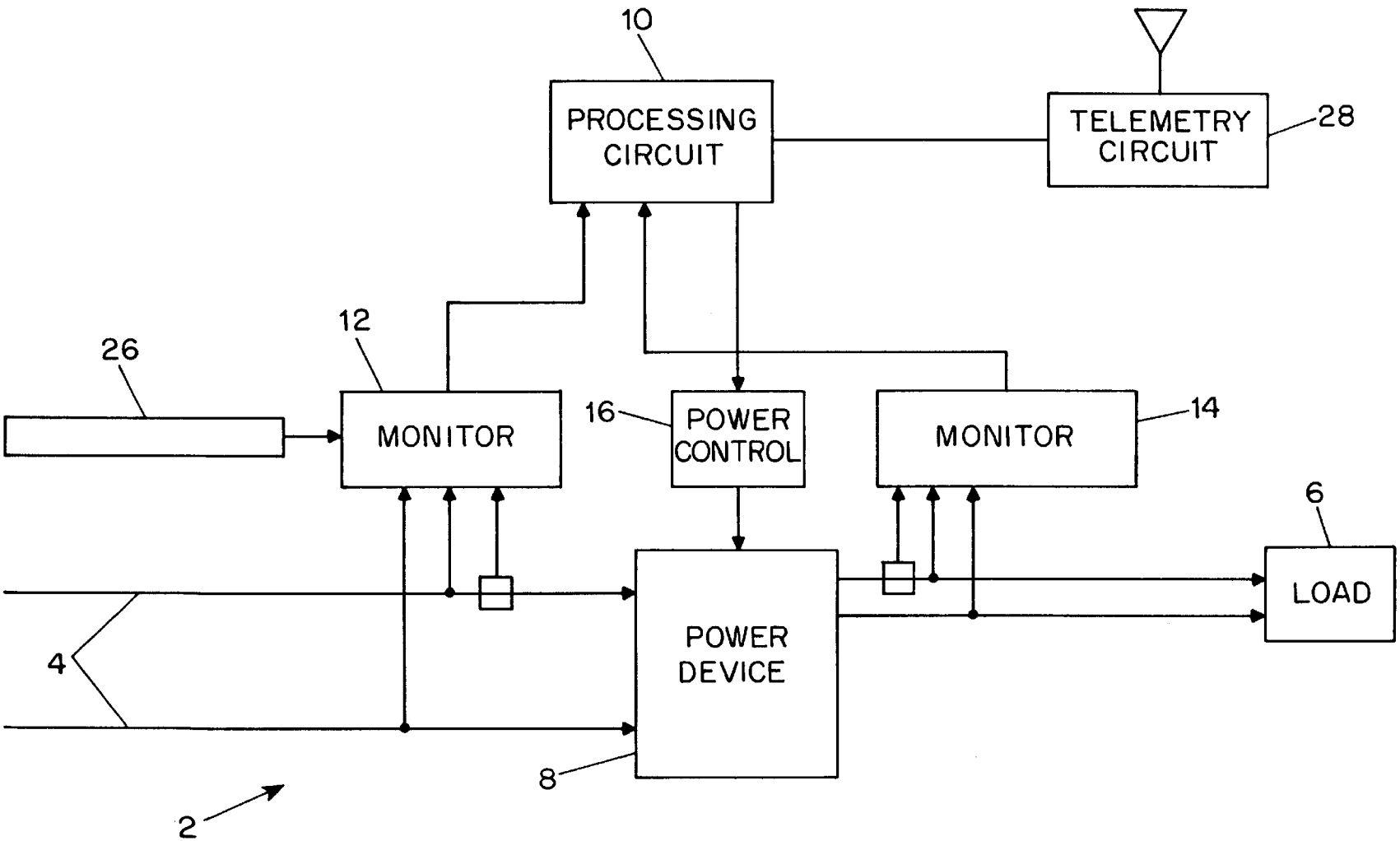
FIG. 3 is a block diagram of a power control apparatus according to a third embodiment.

FIG. 3 is a block diagram illustrating another embodiment of the power control apparatus, which is specifically adapted for use in controlling street lights or the like. Once again this embodiment includes a light level measurement device 26 so that the control apparatus can vary the power supplied by the power device 8 so as to supply the power needed to provide illumination to a preselected level. The light level measurement device is particularly advantageous where the lights comprising the load 6 illuminate an area which also receives natural light, such as a street light, so that power can be reduced to reduce illumination from the light load when additional illumination is supplied naturally (eg when the sun rises). In this embodiment, also, the mico processor 10 includes a control routine which enables it to determine if the light comprising the load 6 is faulty. This can be easily determined by reference to the monitoring signals provided by the output monitoring circuitry 14. The power control apparatus 2 in this instance also includes a telemetry circuit 28 which transmits an output from the digital processing circuit 10 in the event that the light load 6 is faulty. The telemetry circuit 28 transmits its output by way of radio signals or telephony signals, for example, to a central controller (not shown), which can then take action so as to replace the faulty light.

More than one light level measurement device 26 may in fact provide input to the digital processing circuit 10, in order to supply light level measurements from a plurality of locations illuminated by the lighting load 6. In this case, the digital processing circuit 10 may perform a weighted averaging of the light level measurements, for example depending upon the particular positioning of the measurement devices, in order to control the power device 8.

Thus, a plurality of light level measurement devices may provide input signals to the digital processing circuit 10, with the value of each signal being weighted by a respective predetermined weighting value. The weighted light level measurements are then averaged, and the averaged value compared with a preset value stored as a control parameter in memory. This allows the power control apparatus to take account of the actual effect of the load output, so that the averaged light level value and corresponding control parameter can be used to determine the appropriate reduced output power level, rather than a comparison between the output line voltage and the preset reduced output voltage level control parameter. Depending upon the illumination and power saving strategy employed, light level sensors which are placed so as to be affected by natural or external illumination may be treated with greater or lesser weight, as desired. Alternatively, the input signals provided by the plurality of light level sensors may be subjected to a threshold test instead of weighted averaging, wherein the highest or lowest light level sensor signal (averaged over time, perhaps, to allow for transitory variations) is compared with a threshold value to determine if the area concerned is over or under illuminated at any location.

Each power control apparatus 2 can be constructed to control a plurality of loads 6 through a plurality of output power sources 9. One way in which that may be achieved is to construct the power control apparatus with a plurality of power devices 8 coupled to the digital processing circuit 10 in parallel, and with each power device 8 coupled to a separate respective load 6. In order to control the power delivered to each load 6 individually, however, each of the respective power devices 8 should be controlled separately by the digital processing circuit 10, and for that purpose each power device would be provided with a separate control connection to the circuit 10. Furthermore, separate output monitoring circuitry 14 should be included for each power device 8, so that an increase in any individual load 6 can be detected, for example, and dealt with by controlling only the corresponding power device. The input monitoring circuitry 12 may be utilised in common for controlling each of the power devices. Similarly, it is possible to provide a plurality of output power sources from a single power device where the power device comprises a voltage transformer by constructing the transformer with a plurality of secondary outputs which can be tapped individually by connection to respective multiplexing circuits, for example.

In order to control the output power source the control algorithm for the digital processing circuitry 10 must of course be adapted from that described in connection with FIG. 4 to deal with multiple inputs and outputs. One way in which that may be achieved is to arrange the digital processing circuit 10 to multitask or swap between processing tasks utilising time-slices or the like, as is known to those skilled in the art. However, it will also be recognised that, in executing the algorithm illustrated in FIG. 4, most of the time during normal operation the procedure will remain in the monitoring loop comprising steps 122 and 124. Therefore, one way in which the algorithm and digital processing circuit may be adapted for controlling multiple power devices is to provide a similar loop with an interrupt driven by a detected increase in loading on any one of the output power sources coupled to the digital control circuit. When the interrupt is activated the control algorithm of the digital processing circuit is directed to the sub-routine specific to the corresponding load and power device for control of an increase and decremental decrease in supplied power.

As mentioned herinabove, the power control apparatus 2 may also be constructed so as to alter the power level to be output from the power device according to the time of day or day of the week. The control parameter data may be arranged to also store information indicative of temporal changes in the desired output power level, for example by storing day and time data with corresponding reduced output power level values. The control algorithm of the digital processing circuit may also be modified to periodically examine the stored time/day data in order to determine when a stored time and day arises, and to thereupon replace the operative reduced output power level with that corresponding to the matching time and day. For example, in a commercial building it may be desirable to have one power level operative during trading hours, another during the time required by cleaners or the like, and yet another during other times. The manner in which provision for this function can be included in the control algorithm for the digital processing circuit will be readily apparent having regard to the preceding description.

Figure 5:
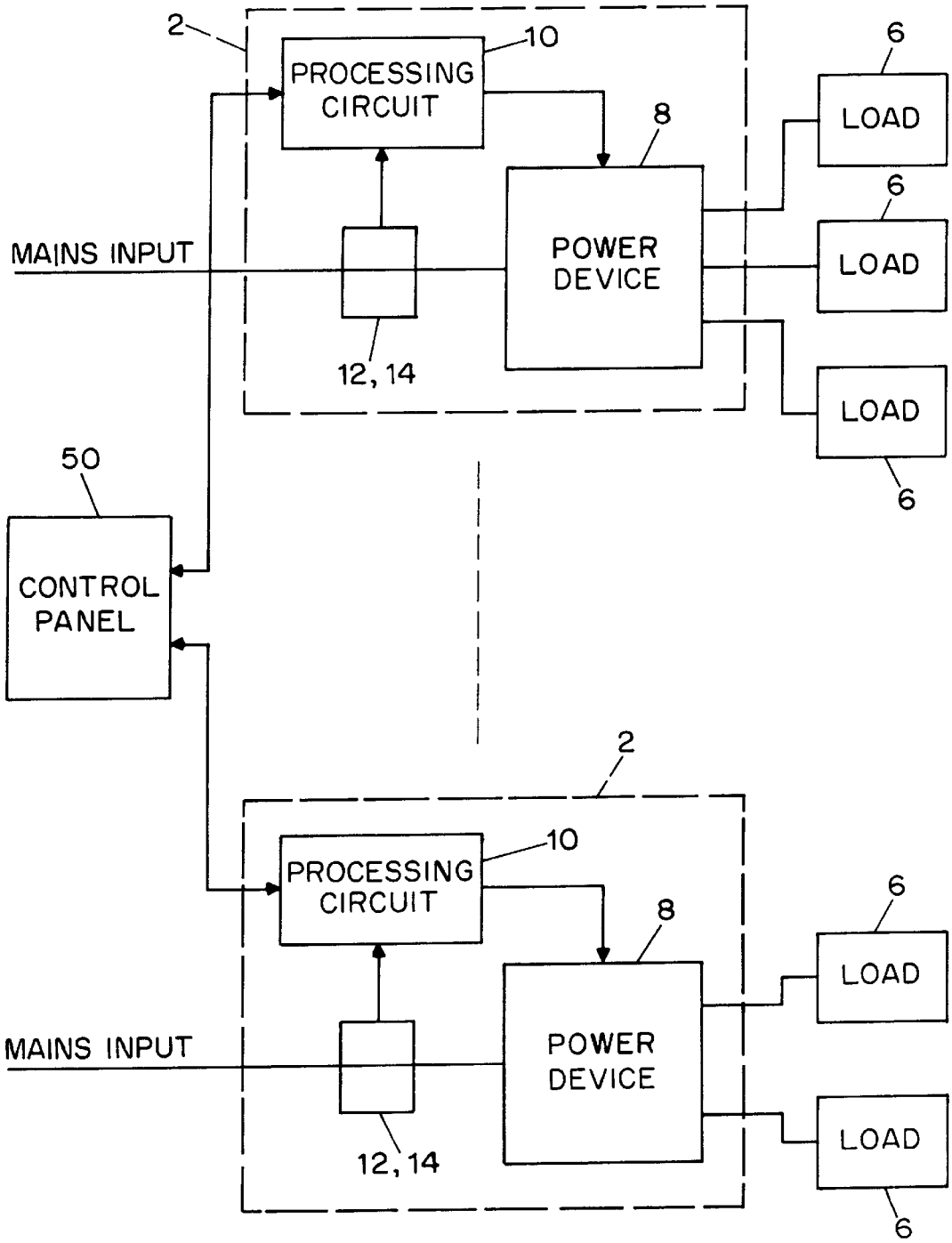
FIG. 5 is a block diagram illustrating a further embodiment of the invention.

The programming port 18 is arranged to receive instructions and/or data from an external source, such as a central control panel. One particular use of the programming port 18 is for alteration of the control parameter data stored in memory in the digital processing circuit 10. For example, if it is desired to increase the light level in a particular area in which illumination is controlled by the power control apparatus, then an instruction may be issued from a remote source, or indeed from a local input keyboard or the like, to alter the control parameter corresponding to the reduced power level. The programming port can be utilised by the power control apparatus to receive data modifying or replacing any of the control parameters described hereinabove, including those for altering the output power level at various times of the day. The digital processing circuit of each power control apparatus is may be individually coded such that only data received at the programming port 18 which is preceded by the correct code will be acted on by the microprocessor. This arrangement operates both as a security measure and as a means for allowing a plurality of power control apparatuses to be coupled to a single central controller communicating on a data bus. An arrangement such as this can be advantageous in a number of applications, such as in a large commercial building. For example, a large retail store having multiple floors might have a separate power control apparatus 2 for controlling the lights on each floor of the building. However, it may also be desirable to have the lights controllable or programmable from a central location such as the security office for the building. In this case a number of power control apparatuses might be connected to a single central control panel 50 in the manner shown in FIG. 5.

The output port 20 mentioned previously also provides for external communication, and might be also connected to a central control panel by the same data bus as the programming port 18. The memory in the digital processing circuit 10 preferably allows storage room for storing data representative of the performance of the power control apparatus for the purposes of evaluation and analysis of power usage. In the simplest implementation, each time the digital processing circuit controls the power device to increase or decrease the power level, an entry is made in the memory storage indicating the time and the resulting power level. This data provides information sufficient to indicate the performance of the power control apparatus. As an additional measure, the output line current value (indicative of load) may be stored at the time of each control change, which aids in determining both loading information, and power consumption information as compared to the same load operating on nominal mains line power without the power control apparatus. The mechanics of storing such information at each control change is well within the ability of the person skilled in the relevant art.

In order to retrieve the performance data stored in the digital processing circuit memory, the circuit 10 and control algorithm is preferably constructed to transmit the stored data on the output port in response to a download command received on the programming port 18 and coded for that particular power control apparatus. The performance data is then transmitted from the digital processing circuit, most likely to a remote site, for analysis and evaluation.

An advantage of utilising a transformer based power device over a waveform modification device, aside from the reduction of noise introduction which may be accomplished, is the benefit of being able to actually increase the output line voltage above that supplied by the input power source. This is particularly advantageous in the case where the mains power supply voltage varies. In that instance, the power control apparatus may compensate for the variation in the supply voltage, even to the point of controlling the output power source voltage to a level higher than the input voltage. For that purpose, where the power device employed is in the form of a transformer, the transformer is advantageously provided with one or more taps which provide a secondary voltage above the primary voltage. The control algorithm can then be further enhanced to monitor the peak line voltage of the input power source and provide a voltage boost when full power is required.

The foregoing detailed description of the invention has been presented by way of example only, and is not intended to be considered limiting to the invention which is defined in the claims appended hereto.

What is claimed is:

1. A power control apparatus for lighting systems comprising:

a power variation means coupled to receive an input power source of a.c. electricity and produce a controllable output power source of a.c. electricity for operating an electrical load comprising at least one light;

monitoring means for monitoring electrical parameters of the input power source and/or the output power source to produce monitoring signals;

a digital processing means coupled to receive said monitoring signals and coupled to said power variation means so as to control said power variation means to vary said output power source between a maximum output level and a minimum output level;

a timer coupled to said digital processing means; and a first memory storing control parameters and coupled to said digital processing means;

wherein said digital processing means is responsive to a condition of said monitoring signals to control said power variation means to produce said output power source at a first predetermined level for a predetermined time period and thereafter to reduce said output power source to a second predetermined level, and wherein said second predetermined level and said predetermined time period are set by said digital processing means according to the control parameters stored in said first memory.

2. A power control apparatus as claimed in claim 1, wherein said stored control parameters include indications of predetermined times of day and/or days of week and corresponding values for said second predetermined level, and wherein said digital processing means is responsive to said timer at said predetermined times of day and/or days of week to change said second predetermined level to the corresponding value stored in said memory.

3. A power control apparatus as claimed in claim 2, wherein said monitoring means monitors changes in line current supplied to said electrical load through said output power source.

4. A power control apparatus as claimed in claim 3, wherein said stored control parameters include a load increase threshold value, and wherein said condition of said monitoring signals to which the digital processing means is responsive is said line current exceeding said load increase threshold value.

5. A power control apparatus as claimed in claim 1, including at least one light sensor coupled to said digital processing means, wherein said digital processing means is responsive to a light level detected by the at least one light sensor to increase or decrease said second predetermined level.

6. A power control apparatus as claimed in claim 5, including a plurality of light sensors coupled to said digital processing means, each producing a respective detected light level value, and wherein said digital processing means is operative to calculate a weighted average of the detected light level values on the basis of preselected respective weighting factors stored in said memory, said digital processing means being responsive to the weighted average to increase or decrease said second predetermined level.

7. A power control apparatus as claimed in claim 1, further comprising an input port coupled to the digital processing means for receiving control commands, wherein said digital processing means is responsive to a first control command to change said stored control parameters including said second predetermined level.

8. A power control apparatus as claimed in claim 7, further comprising a second memory coupled to the digital processing means for storing performance data, and wherein for each power variation in said output power source said digital processing means stores performance data in said second memory.

9. A power control apparatus as claimed in claim 8, wherein said performance data includes data representing the output level of said output power source and the time the power variation occurred.

10. A power control apparatus as claimed in claim 9, further comprising an output port coupled to said digital processing means, and wherein said digital processing means is responsive to a second control command to transmit said performance data stored in said second memory to said output port.

11. A power control apparatus as claimed in claim 1, wherein said monitoring means monitors line voltage and/or line current of said input power source in order to determine the zero crossing times thereof, and wherein said digital processing means is adapted to control said power variation means to vary the output power source substantially only at a said zero crossing time.

12. A power control apparatus as claimed in claim 1, wherein said power variation means comprises a variable transformer, and wherein said first predetermined level corresponds to a larger AC voltage than that of said second predetermined level.

13. A power control apparatus as claimed in claim 1, including a plurality of power variation means coupled to said digital processing means, each power variation device being arranged to supply its output power source to a corresponding different electrical load.

14. A power control apparatus as claimed in claim 13, wherein said digital processing means is adapted to control each of the power variation means according to different corresponding control parameters stored in said first memory.

* * * * *